US012329209B1

(12) United States Patent
Chen

(10) Patent No.: US 12,329,209 B1
(45) Date of Patent: Jun. 17, 2025

(54) ELECTRONIC ATOMIZER CAPABLE OF AUTOMATICALLY EMITTING VAPOR

(71) Applicant: Shenzhen Impetus Technology Co., Ltd., Guangdong (CN)

(72) Inventor: Liqian Chen, Guangdong (CN)

(73) Assignee: Shenzhen Impetus Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/915,823

(22) Filed: Oct. 15, 2024

(30) Foreign Application Priority Data

Aug. 19, 2024 (CN) ..... 202422007234.0

(51) Int. Cl.
*A24F 40/51* (2020.01)
*A24F 7/00* (2006.01)
*A24F 40/485* (2020.01)
*A24F 40/60* (2020.01)

(52) U.S. Cl.
CPC ..... *A24F 40/51* (2020.01); *A24F 7/00* (2013.01); *A24F 40/485* (2020.01); *A24F 40/60* (2020.01)

(58) Field of Classification Search
CPC ..... A24F 40/51; A24F 40/485; A24F 40/40
See application file for complete search history.

(56) References Cited

U.S. PATENT DOCUMENTS

| | | | | |
|---|---|---|---|---|
| 11,969,014 | B2 * | 4/2024 | Qiu | A24F 40/51 |
| 2021/0259313 | A1 * | 8/2021 | Qiu | A24F 40/51 |
| 2022/0225670 | A1 * | 7/2022 | Blackmon | A24F 40/53 |
| 2022/0256933 | A1 * | 8/2022 | Harden | H02J 7/00 |
| 2023/0117750 | A1 * | 4/2023 | Singleton | A24F 40/85 131/329 |
| 2023/0363447 | A1 * | 11/2023 | Lyell | A24F 40/40 |

* cited by examiner

*Primary Examiner* — Hae Moon Hyeon

(57) ABSTRACT

An electronic atomizer includes a housing, an atomization device, a blowing device, a cover, and a sensor switch. The housing defines a second vapor outlet and a first air inlet. The atomization device is disposed within the housing, and defines a first vapor outlet, and a second air inlet. The first vapor outlet is communicated with the first vapor outlet. The blowing device is disposed on one side of the second air inlet, the blowing device is configured to direct gas entering the housing via the first air inlet towards the atomization device through the second air inlet. The cover is disposed on the housing. The sensor switch includes a first sensing component, and a second sensing component. The first sensing component is mounted on the cover, the second sensing component is mounted on the housing and is electrically connected to both the atomization device and the blowing device.

10 Claims, 8 Drawing Sheets

ELECTRONIC ATOMIZER CAPABLE OF AUTOMATICALLY EMITTING VAPOR

CROSS REFERENCE TO RELATED APPLICATIONS

This non-provisional patent application claims priority under 35 U. S. C. § 119 from Chinese Patent Application No. 202422007234.0 filed on Aug. 19, 2024, the entire content of which is incorporated herein by reference.

TECHNICAL FIELD

This disclosure relates to electronic atomizer technologies, and more specifically, relates to an electronic atomizer capable of automatically emitting vapor.

BACKGROUND

An electronic atomizer is a device that generates vapor by heating chemicals or other substances, which is then inhaled by users. This type of the electronic atomizer finds widespread application across various fields. For instance, in medical fields, it can be used for nebulization therapy, helping patient alleviate symptoms such as coughing. Furthermore, the electronic atomizer is also employed in other fields, such as vaporizing e-liquid to create vapor that, mimics traditional cigarettes. In essence, depending on the substance being atomized, the electronic atomizer boasts diverse and multifaceted applications across multiple fields.

However, existing electronic atomizers require user inhalation to initiate operation, as well as to draw out the generated vapor.

SUMMARY

The purpose of the disclosure is to provide an automatic vapor-emitting electronic atomizer, which aims to solve the technical problems mentioned in the aforementioned background technology.

The present disclosure provides an electronic atomizer capable of automatically emitting vapor, including a housing, an atomization device, a blowing device, a cover, and a sensor switch. The housing defines a second vapor outlet and a first air inlet. The atomization device is disposed within the housing, and defines a first vapor outlet, and a second air inlet. The first vapor outlet is communicated with the second vapor outlet. The blowing device is disposed on one side of the second air inlet, and configured to direct gas entering the housing via the first air inlet towards the atomization device through the second air inlet. The cover is disposed on the housing to cover or uncover the second vapor outlet. The sensor switch includes a first sensing component, and a second sensing component that are cooperated with each other. The first sensing component is disposed on the cover, the second sensing component is disposed on the housing, the second sensing component is electrically connected to both the atomization device and the blowing device. When the cover is opened to expose the second vapor outlet, the first sensing component moves away from the second sensing component, triggering the second sensing component to activate the atomization device and the blowing device.

It can be seen that in the electronic atomizer, a blowing device is arranged on one side of the second air inlet of the atomization device. The blowing device is used to blow the gas blow the gas entering the housing through the first air inlet towards the atomization device through the second air inlet and then blow the vapor generated in the atomization device out of the housing through the first vapor outlet and the second vapor outlet in sequence, realizing the automatic vapor deliver of the electronic atomizer. Moreover, a cover is arranged on the housing for opening or closing the second vapor outlet, and a first sensing component is disposed on the cover, while the second sensing portion is disposed on the housing, and the second sensing component is electrically connected to both the atomization device and the blowing device. In this way, when the cover opens the second vapor outlet, the atomization device and the blowing device can work at the same time, that is, the second vapor outlet can automatically deliver vapor after being opened, making the use of the electronic atomizer more convenient. It can be seen that the electronic atomizer of the present application can automatically emit vapor when opening the cover, thereby facilitating the use of the electronic atomizer.

Furthermore, the cover is rotatably mounted on the housing; the cover defines a receiving groove to receive the first sensing component; the receiving groove accommodates an end of the housing with the second vapor outlet Furthermore, a mouthpiece is disposed on the housing, the second vapor outlet is defined at the mouthpiece, the mouthpiece is accommodated in the receiving groove.

Furthermore, the electronic atomizer further includes a main board disposed within the housing, the main board is electrically connected to the atomization device, the blowing device, and the second sensing component.

Furthermore, the electronic atomizer further includes a button and a microphone. The button is disposed on the housing and electrically connected to the main board. The microphone is disposed within the housing and located on an airway between the second vapor outlet and the first air inlet, the microphone is electrically connected to the main board.

Furthermore, a third vapor outlet is defined on the cover, the third vapor outlet is communicated with the second vapor outlet.

Furthermore, the housing comprises an outer casing and a base; the second vapor outlet is defined at one end of the outer casing; the atomization device is detachably connected to the base; when the base is connected to the outer casing, the atomization device is received within the outer casing.

Furthermore, the cover and the second sensing component are respectively disposed on the outer casing, and the main board is disposed within the base; the second sensing component is electrically connected to the main board through contact pins and contact points; the electronic atomizer further comprises a power supply, disposed within the outer casing and electrically connected to the main board through contact pins and contact points.

Furthermore, the electronic atomizer includes a mounting seat, and an electrodes, the mounting seat and the electrode are electrically connected to the main board to form a positive pole and a negative pole; the mounting seat being disposed on the base and defining a first through hole, the electrode being disposed within the first through hole, and an insulating member is located between the electrode and the mounting seat; the electrode defines a second through hole; the atomization device is connected to the mounting seat and simultaneously coming into contact with the electrodes, the second air inlet is communicated with the second through hole; the blowing device is disposed on one side of the second through hole away from the atomization device.

Furthermore, the electronic atomizer further includes a ventilation component, the ventilation component has a first air outlet and a second air outlet that are communicated with each other; the first air outlet is coupled to one end of the electrode away from the atomization device, enabling communication between the first air outlet and the second through hole; the blowing device is coupled to the second air outlet, allowing the blowing device blows air towards the second air outlet.

BRIEF DESCRIPTION OF THE DRAWINGS

In order to more clearly illustrate the technical solutions embodied in the embodiments of the disclosure, the following provides a brief introduction to the drawings required in the description of the embodiments or prior art. It is evident that the drawings described below are merely representative examples of the disclosure. For an ordinary skilled person in the art, without exercising any inventive step, further drawings can be derived based on these drawings.

FIGURE MARKS

Figure 1:
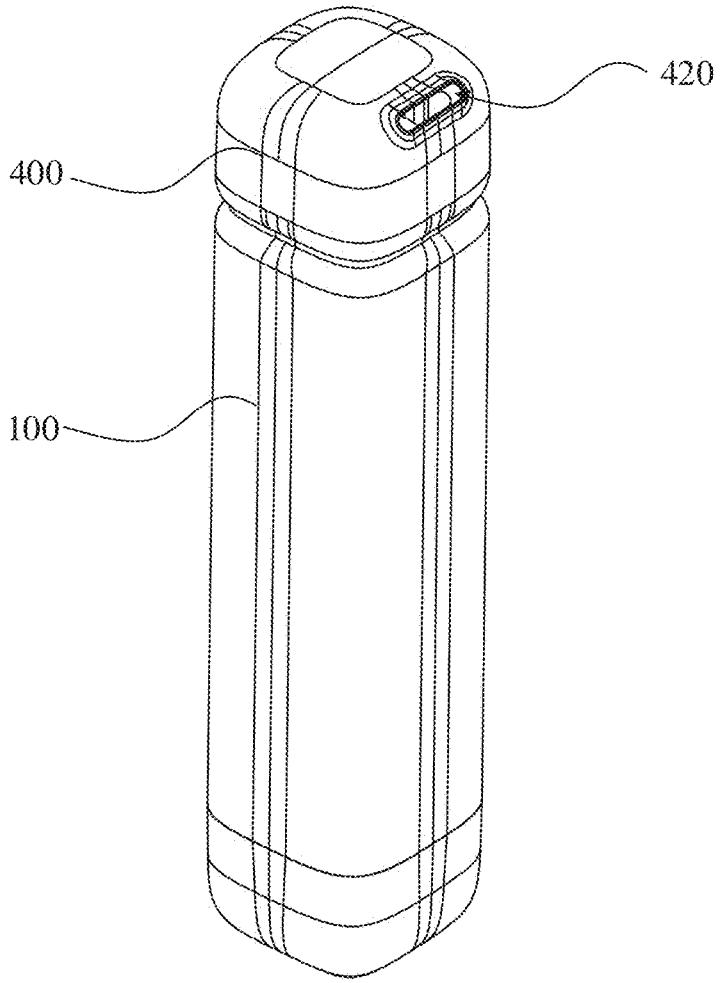
FIG. 1 illustrates an electronic atomizer with the cover being in a close status according to an embodiment.

100, housing; 110*a*, Second vapor outlet; 110*b*, First air inlet; 120, Mouthpiece; 140, Outer housing; 141, Accommodation chamber; 142, Airflow channel; 150, Base; 160*a*, First magnetic attraction element; 160*b*, Second magnetic attraction element; 170*a*, Mounting seat; 170*b*, Electrode; 170*c*, Insulating member; 171*a*, First through hole; 171*b*, Second through hole; 200, Atomization device; 210*a*, First vapor outlet; 210*b*, Second air inlet; 300, Air blowing device; 400, Cover; 410, Receiving groove; 420, Third vapor outlet; 500, Sensing switch; 510, First sensing component; 520, Second sensing component; 600, main board; 700, Button; 800, Microphone; 900, Ventilation component; 910*a*, First air outlet; 910*b*, Second air outlet; 1000*a*, Contact point; 1000*b*, Spring pin; 1100, Power supply.

DETAILED DESCRIPTION OF THE EMBODIMENTS

In order to make the technical problems to be solved, the technical solutions, and the beneficial effects of the present disclosure clearer and more understandable, the following provides a further detailed description of the present disclosure with reference to the accompanying drawings and embodiments. It should be understood that the specific embodiments described here are merely used to explain the present disclosure, and are not intended to limit the present disclosure.

It should be noted that when an element is referred to as being "fixed to" or "disposed on" another element, it can be directly on the other element or indirectly attached thereto. When an element is referred to as being "connected to" another element, it can be directly connected to the other element or indirectly connected thereto.

It should be understood that the terms such as "length", "width", "upper", "lower", "front", "rear", "left", "right", "vertical", "horizontal" "top", "bottom", "inner", and "outer" used to indicate the direction or positional relationship are based on the direction or positional relationship shown in the drawings, which are merely for the convenience of describing and simplifying the disclosure, and do not indicate or imply that the device or element must have a specific direction or structure, and thus should not be understood as limiting the disclosure.

Furthermore, the terms "first" and "second" are used merely for descriptive purposes and are not intended to indicate or imply relative importance or implicitly specify the quantity of the technical features indicated. Thus, the features designated with "first" and "second" can explicitly or implicitly encompass one or more of those features. In some descriptions of the disclosure, the term "plurality" refers to two or more, unless otherwise specifically defined.

Referring FIGS. 1 to 10, the disclosure provides an electronic atomizer capable of automatically emitting vapor, including a housing 100, an atomization device 200, a blowing device 300, a cover 400, and a sensing switch 500.

Figure 2:
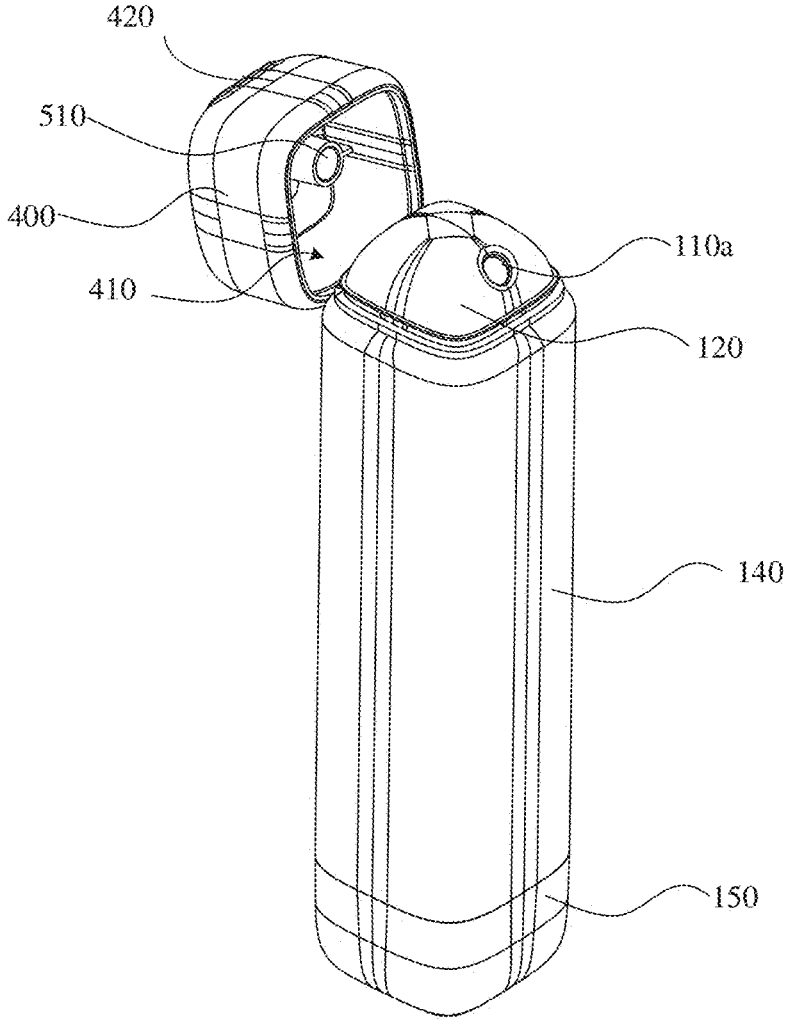
FIG. 2 illustrates the electronic atomizer with the cover being in an open status according to an embodiment.
Figure 3:
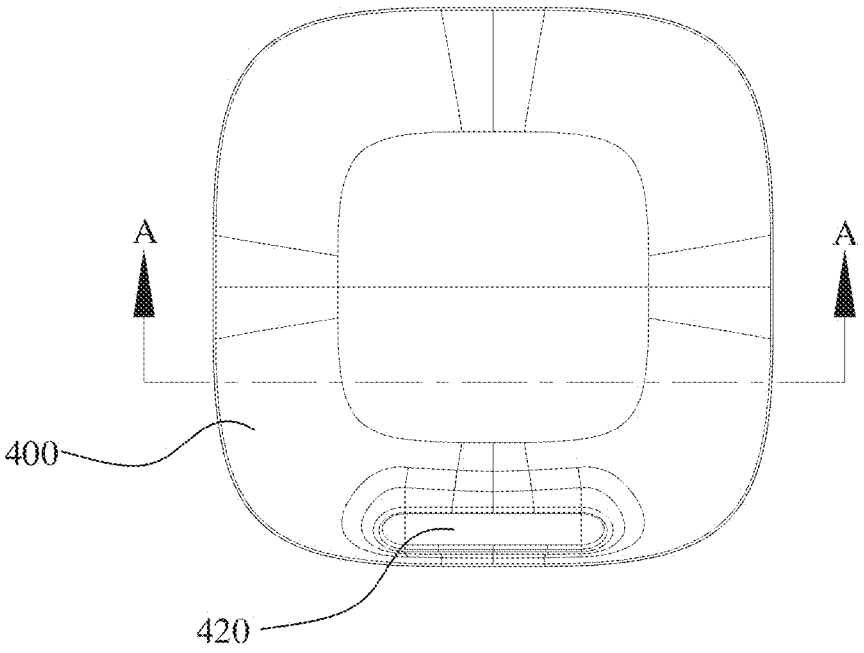
FIG. 3 is a top view of the electronic atomizer according to an embodiment.
Figure 7:
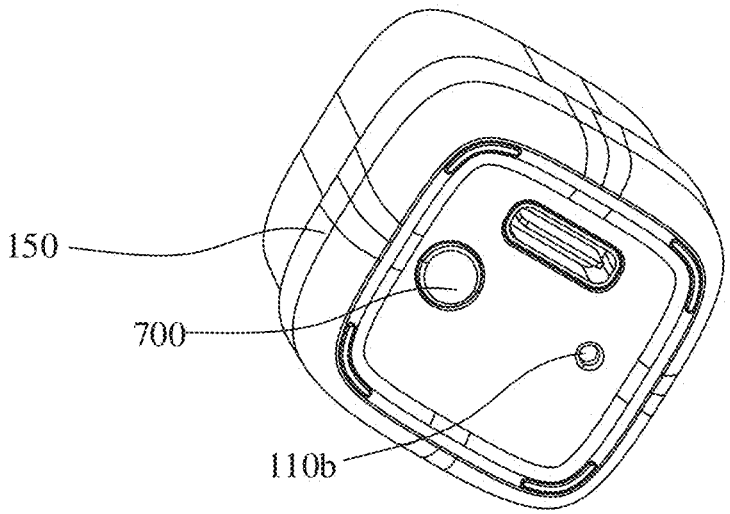
FIG. 7 illustrates the base of an electronic atomizer according to a second embodiment.
Figure 8:
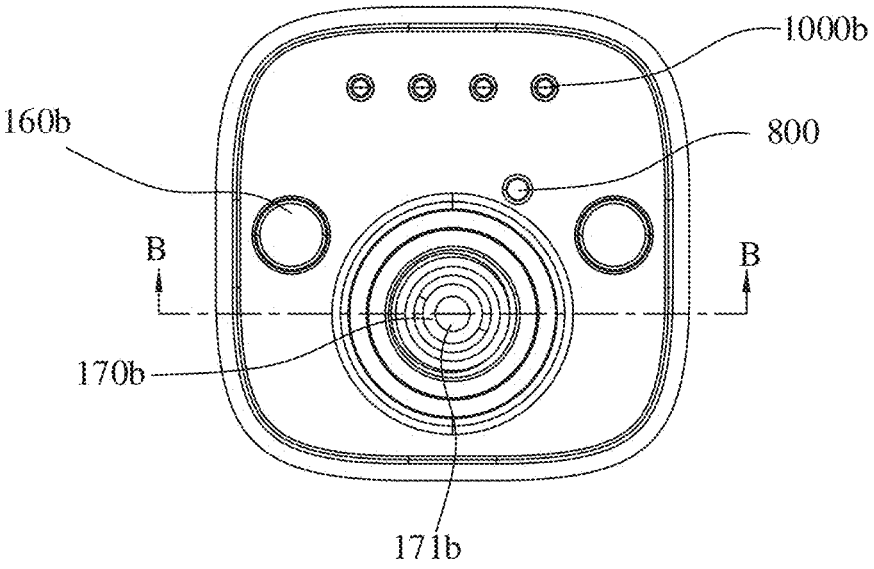
FIG. 8 illustrates the base of an electronic atomizer according to a third embodiment.

Referring to FIGS. 2 and 7, the housing 100 defines a second vapor outlet 110*a*, and a first air inlet 110*b*. For example, the second vapor outlet 110*a* is disposed at one end of the housing 100, and the first air inlet 110*b* is disposed at other end of the housing 100. The first air inlet 110*b* is configured to allow external gas (such as air) to enter into the housing 100, while the second vapor outlet 110*a* is configured to discharge the vapor out of the housing 100.

Figure 4:
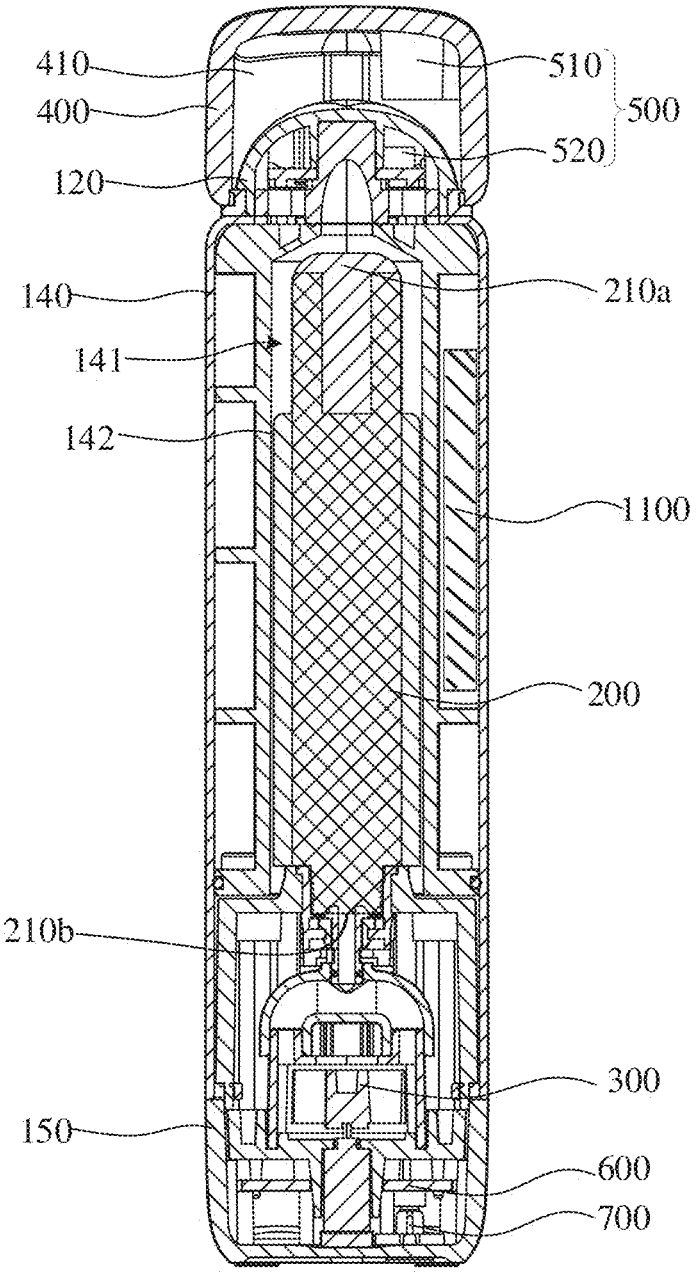
FIG. 4 is a cross-sectional view taken along line A-A in FIG. 3, illustrating an interior structure of an electronic atomizer according to an embodiment.

Referring to FIG. 4, the atomization device 200 is disposed within the housing 100, and defines a first vapor outlet 210*a* and a second air inlet 210*b*. It is understood that the atomization device 200 is capable of generating vapor, for example, by atomizing e-liquid, vapor paste, tobacco leaves, or other medical liquids to produce vapor. The external gas enters the atomization device 200 through the first air inlet 110*b*, a ventilation component 900, the second air inlet 210*b* and then exits the vapor generated through the atomization device 200 out through the first vapor outlet 210*a*.

Furthermore, the first vapor outlet 210*a* of the atomization device 200 is communicated with the second vapor outlet 110*a*. That is, the vapor generated by the atomization device 200 within the housing 100 is discharged outside the housing 100 through the second vapor outlet 110*a* when the cover 400 is opened.

The blowing device 300 is disposed on one side of the second air inlet 210*b* of the atomization device 200 and directly below an electrode 170*b*. The blowing device 300 is used to blow the gas entering the housing 100 through the first air inlet 110*b* into the atomization device 200 through a second through-hole 171*b* and then the second air inlet 210*b*, thereby blowing the vapor generated within the atomization device 200 out through the first vapor outlet 210*a* and the second vapor outlet 110*a* to the outside of the housing 100, realizing automatic smoking of the electronic atomizer and facilitating user inhalation.

Referring FIGS. 1 and 2, the cover 400 is disposed on the housing 100 for opening or closing the second vapor outlet 110*a*.

Referring to FIG. 4, the sensing switch 500 includes a first sensing component 510 and a second sensing component 520 that cooperate to each other. The first sensing component 510 is disposed on the cover 400, and the second sensing component 520 is mounted on the housing 100. The second sensing component 520 is electrically mounted to both the atomization device 200 and the blowing device 300. When the cover 400 is opened, exposing the second vapor outlet 110*a*, the first sensing component 510 moves away from the second sensing component 520, at which point the second sensing component 520 enables the atomization device 200 and the blowing device 300 to operate. The atomization device 200 generates vapor, which is then blown out of the housing 100 by the blowing device 300 for user inhalation.

In use, the cover 400 is opened to expose the second vapor outlet 110*a*. During this process, the first sensing component 510 on the cover 400 moves away from the second sensing component 520 on the housing 100. When the second sensing component 520 senses the movement, it triggers the atomization device 200 and the blowing device 300 to operate, for example, by sending operation signals to the atomization device 200 and the blowing device 300. The blowing device 300 then blows the vapor generated by the atomization device 200 out of the housing 100 for user inhalation.

It can be seen that in the electronic atomizer described above, the blowing device 300 is disposed on one side of the second air inlet 210*b* of the atomization device 200 and directly below the electrode 170*b*, to direct the gas entering the housing 100 through the first air inlet 110*b*, into the atomization device 200 through the second through-hole 171*b* and the second air inlet 210*b* and then blow the vapor generated within the atomization device 200 out through the first vapor outlet 210*a* and the first vapor outlet 110*a* to realize automatic smoking. Furthermore, the housing 100 is provided with the cover 400 that enables the second vapor outlet 110*a* to open or close, and the first sensing component 510 is mounted on the cover 400, and the second sensing component 520 is mounted on the housing 100. In this way, when the cover 400 is opened, exposing the second vapor outlet 110*a*, simultaneously activates the atomization device 200 and the blowing device 300, thereby enabling automatic smoking and facilitating the use of the electronic atomizer.

Furthermore, in some embodiments, the sensing switch 500 is a magnetic sensing switch. For example, the first sensing component 510 may be a magnet, and the second sensing component may be an induction coil.

Referring to FIGS. 1 and 2, the cover 400 is mounted on the housing 100. Specifically, in some embodiments, the cover 400 is rotatably disposed on the housing 100 to open or close the second vapor outlet 110*a*. In other embodiments, the cover 400 may also be detachably mounted on the housing 100, such as through snap-fit connection.

Furthermore, referring to FIG. 2, the cover 400 defines a receiving groove 410, and the first sensing component 510 is received within the receiving groove 410. This facilitates the disposition of the first sensing component 510 on the cover 400.

In some embodiments, the receiving groove 410 accommodates the end of the housing 100 defining the second vapor outlet 110*a*. For example, when the cover 400 is rotatably mounted on the housing 100, one end of the cover 400 is rotatably connected to the housing 100, while the other end of the cover 400 can move towards or away from the housing 100. When the other end of the cover 400 moves towards the housing 100, the cover 400 closes the second vapor outlet 110*a*, and at the same time, the end of the housing 100 having the second vapor outlet 110*a* is accommodated within the receiving groove 410, preventing contamination of the second vapor outlet 110*a* and the surrounding area of the housing 100.

Certainly, in some embodiments, to facilitate the disposition of the second vapor outlet 110*a*, a mouthpiece 120 is mounted to the housing 100, and the mouthpiece 120 defines the second vapor outlet 110*a*. The mouthpiece 120 is detachably connected to the housing 100, such as through snap-fit connection, facilitating assembly between the mouthpiece 120 and the housing 100.

In some embodiments, to facilitate the disposition of the second sensing component 520 and the cooperation between the first sensing component 510 and the second sensing component 520, the second sensing component 520 may also be disposed within the mouthpiece 120.

Figure 9:
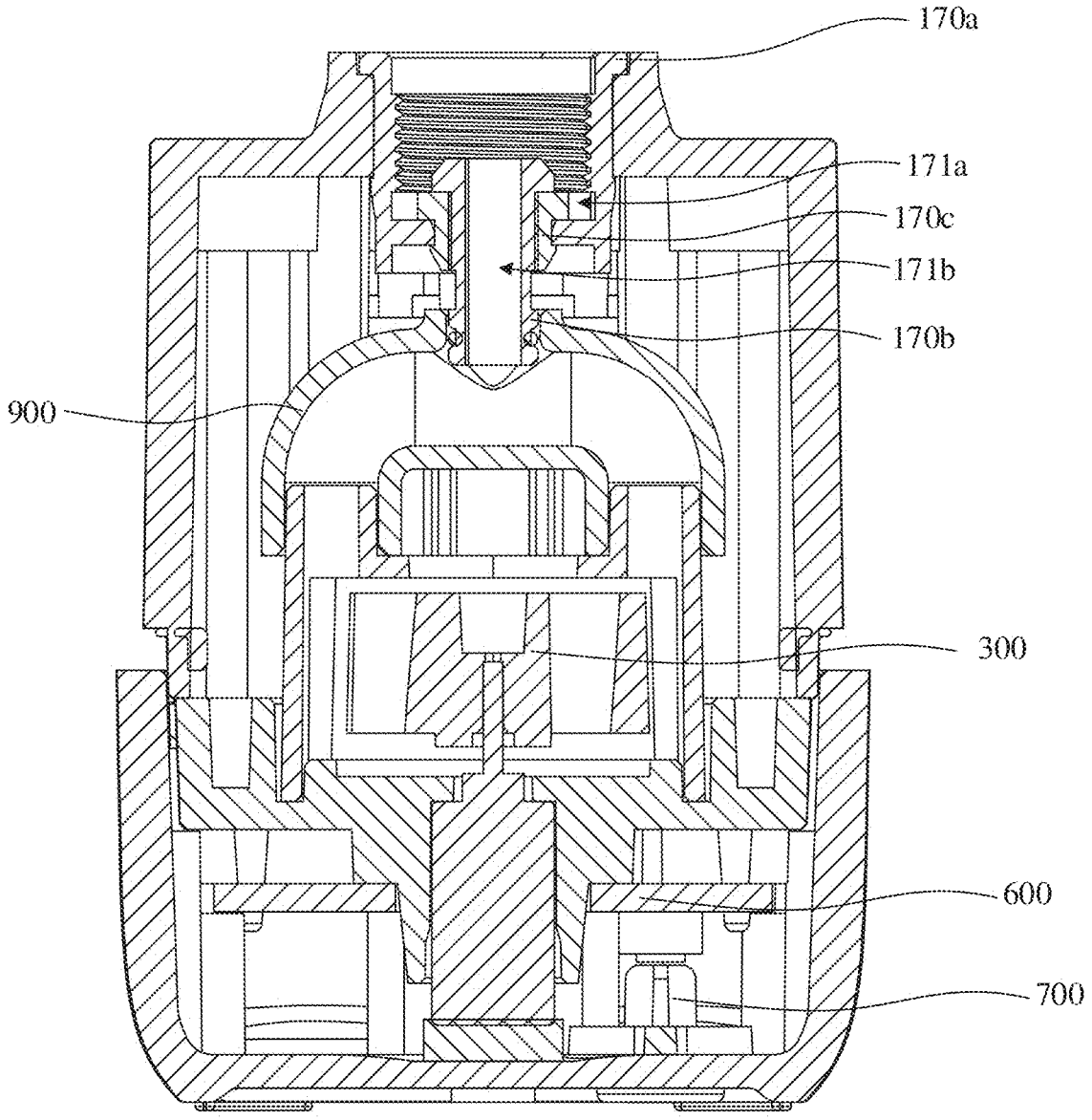
FIG. 9 is a cross-sectional view taken along line B-B in FIG. 8, illustrating the detailed structure of the base of the electronic atomizer according to an embodiment.
Figure 10:
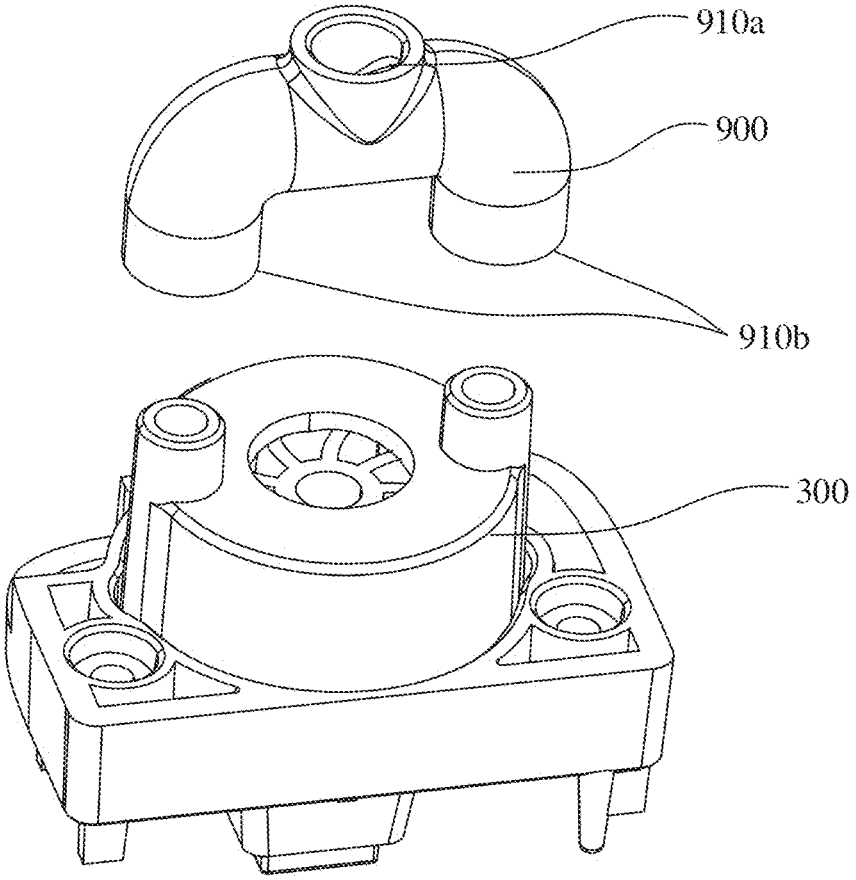
FIG. 10 is an exploded view illustrating assembly of an air blowing device and the atomization device in the electronic atomizer according to an embodiment.

Referring to FIGS. 4 and 9, to facilitate controlling the operation of the electronic atomizer, the electronic atomizer may further include a main board 600, which controls the operation of the electronic atomizer.

Specifically, the main board 600 is received within the housing 100 and is electrically connected to the atomization device 200, the blowing device 300, and the second sensing component 520.

During operation, when the cover 400 is opened, the second vapor outlet 110*a* becomes exposed, the first sensing component 510 moves away from the second sensing component 520. The second sensing component 520 then sends a sensing signal to the main board 600, which activates the atomization device 200 and the blowing device 300 to operate.

Furthermore, referring to FIGS. 4, 7, and 9, to provide users with more usage experiences, the electronic atomizer may further include a button 700, which is disposed on the housing 100 and electrically connected to the main board 600. Users can control the operation of the atomization device 200 or both the blowing device 300 and the atomization device 200 through the button 700 and the main board 600. Additionally, the button 700 can also control the power-on/power-off state and the working mode of the electronic atomizer.

Figure 6:
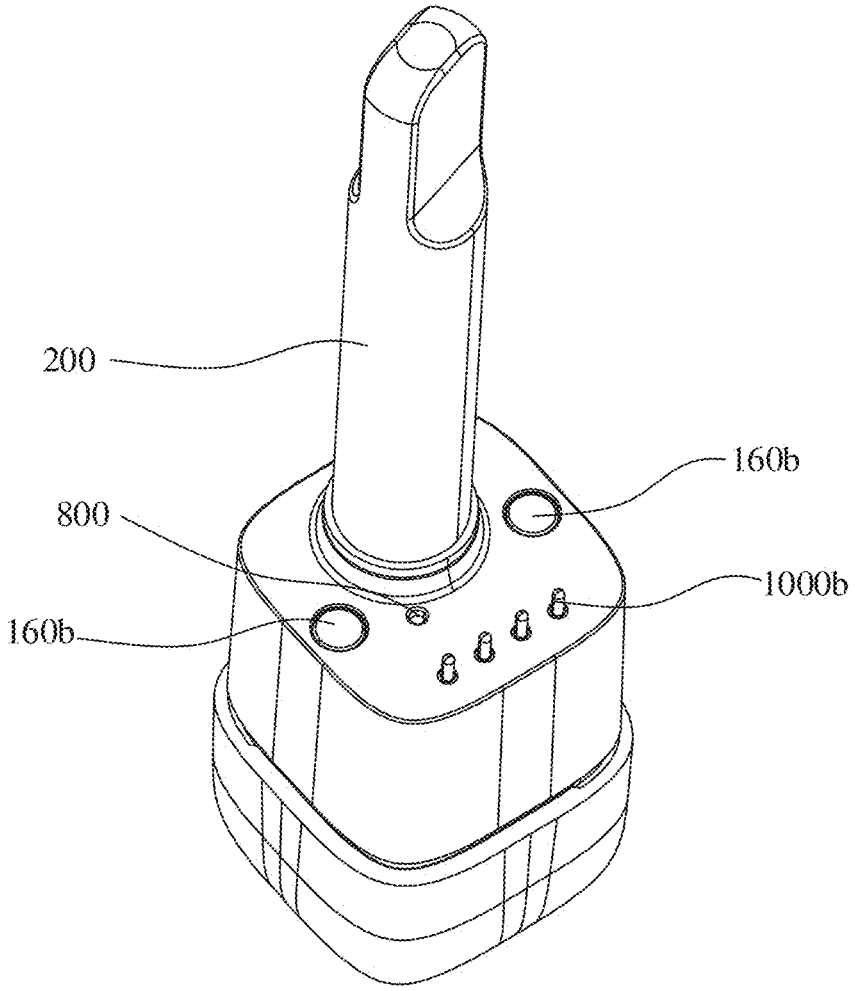
FIG. 6 illustrates a base of the electronic atomizer according to a first embodiment

Furthermore, referring to FIG. 6, in some embodiments, the electronic atomizer may further include a microphone 800, which is positioned within the housing 100 and located on the air path between the second vapor outlet 110*a* and the first air inlet 110*b*, and is electrically connected to the main board 600. When automatic smoking is not required, users can inhale through the second vapor outlet 110*a*, causing the microphone 800 to sense the airflow and send a sensing signal to the main board 600, which then controls the atomization device 200 to operate, allowing users to inhale the vapor generated by the atomization device 200 through the second vapor outlet 110*a*. This enables the electronic atomizer to both realize automatic smoking and allow users to inhale vapor through traditional inhalation, enhancing user experience.

Moreover, referring to FIG. 1, in some embodiments, the cover 400 may further include a third vapor outlet 420, which is communicated with the second vapor outlet 110*a*.

When a receiving groove 410 is defined on the cover, the third vapor outlet 420 may communicate with the second vapor outlet 110*a* through the receiving groove 410.

Specifically, in some embodiments, users can directly inhale through the third vapor outlet 420, causing the microphone 800 to sense the airflow and then control the atomization device 200 to generate vapor for user inhalation without opening the cover 400, providing convenience.

Alternatively, in other embodiments, the atomization device 200 and the blowing device 300 can be controlled through the button 700, so that the vapor generated by the atomization device 200 is sequentially blown out through the first second vapor outlet 210*a*, the second vapor outlet 110*a*, and the third vapor outlet 420 outside the cover 400, allowing the users to inhale without opening the cover 400.

In other words, the above-mentioned embodiments provide users with a plurality of usage options for the electronic atomizer.

Additionally, it should be noted that in some embodiments, although the third vapor outlet 420 communicating with the second vapor outlet 110*a* is disposed on the cover 400, when the cover 400 moves towards a position that opens the second vapor outlet 110*a*, as the first sensing component 510 moves away from the second sensing component 520, the second sensing component 520 can still enable the atomization device 200 and the blowing device 300 to operate through the sensing signal, realizing automatic smoking when opening the cover 400.

Referring to FIGS. 5 to 9, in some embodiments, to facilitate replacing the atomization device 200, the housing 100 includes an outer casing 140 and a base 150. The outer casing 140 has the second vapor outlet 110*a* disposed at one end. The base 150 is detachably connected to the end of the outer casing 140 away from the second vapor outlet 110*a*. The first air inlet 110*b* is disposed on the base 150, and the atomization device 200 is detachably disposed on the base 150. When the base 150 is connected to the outer casing 140, the atomization device 200 is accommodated within the outer casing 140.

It is understood that when the atomization device 200 is disposed on the base 150, the blowing device 300 is correspondingly disposed on the base 150 to facilitate blowing air towards the atomization device 200.

To replace the atomization device 200, the base 150 can be detached from the outer casing 140, and then the atomization device 200 can be detached from the base 150 for replacement. After replacement, the base 150 can be reattached to the outer casing 140.

Figure 5:
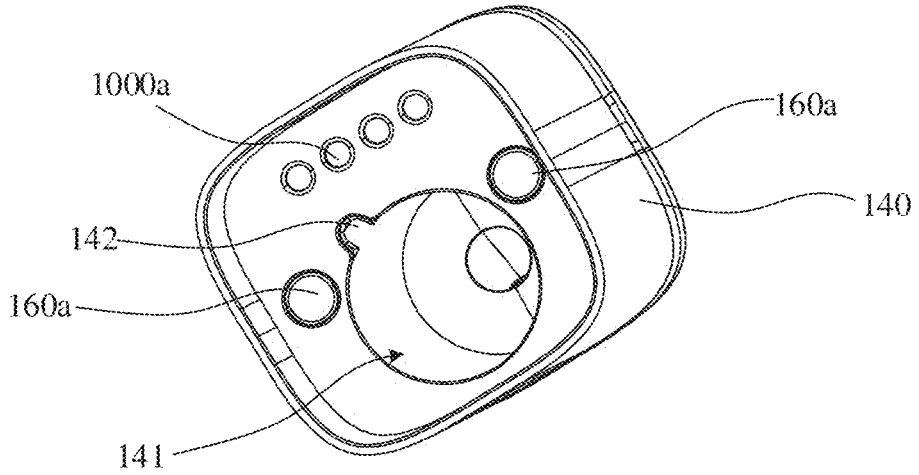
FIG. 5 illustrates an outer housing of the electronic atomizer according to an embodiment of the disclosure.

Specifically, referring to FIGS. 5 and 6, in some embodiments, the base 150 and the housing 100 may be detachably connected through magnetic attraction. For example, a first magnetic attraction component 160*a* is mounted on the outer casing 140, and a second magnetic attraction component 160*b*, which cooperates with the first magnetic attraction component 160*a*, is mounted on the base 150.

Specifically, referring to FIG. 9, in some embodiments, to facilitate replacing the atomization device 200, the electronic atomizer may further include a mounting seat 170*a* and an electrode 170*b*, both of which are electrically connected to the main board 600 to form positive and negative poles. The mounting seat 170*a* is disposed on the base 150 and has a first through-hole 171*a* penetrating therethrough. The electrode 170*b* is disposed within the first through-hole 171*a*, and an insulating member 170*c* is disposed between the electrode 170*b* and the mounting seat 170*a*. The electrode 170*b* defines a second through-hole 171*b*. The atomization device 200 is connected to the mounting seat 170*a* and simultaneously contacts the electrode 170*b*, and the second air inlet is communicated with the second through-hole 171*b* and the blowing device 300. The blowing device 300 is disposed on the side of the second through-hole 171*b* away from the atomization device 200 and directly below the electrode 170*b*.

It is understood that when the atomization device 200 is connected to the mounting seat 170*a* and contacts the electrode 170*b*, the atomization device 200 is electrically connected to the positive pole and negative pole, allowing the main board 600 to control the operation of the atomization device 200.

Furthermore, since the electrode 170*b* defines the second through-hole 171*b* communicated with the second air inlet, and the blowing device 300 is disposed on the side of the second through-hole 171*b* away from the atomization device 200, the blowing device 300 can blow air through the second through-hole 171*b* into the atomization device 200.

To ensure that the blowing device 300 can supply sufficient airflow into the atomization device 200, enabling the electronic atomizer to produce sufficient vapor, the electronic atomizer may further include a ventilation component 900, which has a first air outlet 910*a* and two second air outlets 910*b*. The first air outlet 910*a* is attached to the end of the electrode 170*b* away from the atomization device 200, establishing communication between the first air outlet 910*a* and the second through hole 171*b*, for instance, by being sleeved over the electrode 170*b*. The blowing device 300 is then communicate with the two second air outlets 910*b*, allowing the blowing device 300 to blow air out and through the two second air outlets 910*b*.

Referring to FIG. 6, when the housing 100 includes the outer casing 140 and the base 150, the microphone 800 can be disposed on the base 150. Specifically, a through-hole communicating with the interior of the base 150 is defined on the end surface of the base 150, and the through-hole can be positioned near the installation position of the atomization device 200, with the microphone 800 located within the through-hole. After the base 150 is mounted on the outer casing 140, the through-hole can communicate with the second vapor outlet 110*a*.

For example, as shown in FIGS. 4 and 5, an accommodating cavity 141 is defined inside the outer casing 140, with one end of the accommodating cavity 141 communicating with the second vapor outlet 110*a*, and the other end of the accommodating cavity 141 extending to the other end of the outer casing 140 to form an opening. When the base 150 is mounted on the outer casing 140, the atomization device 200 on the base 150 is accommodated within the accommodating cavity 141 through the opening, and an airflow channel 142 is formed between the atomization device 200 and the sidewall of the accommodating cavity 141, with the airflow channel 142 communicating with the second vapor outlet 110*a* and the through-hole respectively.

As shown in FIGS. 4, 5, and 6, when the housing 100 includes the outer casing 140 and the base 150, the cover 400 and the second sensing component 520 are mounted on the outer casing 140 respectively, and the main board 600 can be received within the base 150. The cover 400 can be rotatably connected to the outer casing 140 to open or close the second first vapor outlet 110*a*. The second sensing component 520 is electrically connected to the main board 600 through contact connection between a spring pin 1000*b* and a contact point 1000*a*, i.e., after the base 150 is mounted to the outer casing 140, the second sensing component 520 achieves electrical connection with the main board 600 through contact connection between the spring pin 1000*b* and the contact point 1000*a*.

Of course, in some embodiments, the main board 600 can also be received within the outer casing 140, and components such as the atomization device 200, the microphone 800, the air blowing device 300, and the button 700 are electrically connected to the main board 600 by contacting the spring pins 1000*b* to the points 1000*a* respectively.

In some embodiments, the electronic atomizer can also include a power supply 1100, which can be a rechargeable battery. The power supply 1100 is disposed within the outer casing 140 and is electrically connected to the main board 600 through contact connection between a spring pin 1000*b* and a contact point 1000*a*.

For example, the contact points 1000*a* are disposed on the outer casing 140, with the second sensing component 520 and the power supply 1100 electrically connected to the contact points 1000*a* respectively. The spring pins 1000*b* are disposed on the base 150, and the main board 600 is electrically connected to the spring pins 1000*b*. When the base 150 is mounted on the housing 100, the spring pins 1000*b* contact the contact points 1000*a*.

The above are of the disclosure and are not intended to limit the disclosure. Any modifications, equivalent substitutions, and improvements made within the spirit and principles of some disclosures should be included within the scope of protection of the disclosures.

The invention claimed is:

1. An electronic atomizer capable of automatically generating vapor, comprising:

a housing, defining a second vapor outlet, and a first air inlet;

an atomization device, disposed within the housing, the atomization device defining a first vapor outlet, and a second air inlet, and the first vapor outlet communicated with the second vapor outlet;

a blowing device, disposed on one side of the second air inlet, the blowing device being configured to direct gas entering the housing via the first air inlet towards the atomization device through the second air inlet;

a cover, disposed on the housing, for opening or closing the second vapor outlet; and a sensor switch, comprising a first sensing component, and a second sensing component that are cooperated with each other; the first sensing component disposed on the cover, the second sensing component disposed on the housing, the second sensing component electrically connected to both the atomization device and the blowing device; when the cover is opened to expose the second vapor outlet, the first sensing component moving away from the second sensing component, triggering the second sensing component to activate the atomization device and the blowing device.

2. The electronic atomizer capable of automatically generating vapor according to claim 1, wherein the cover is rotatably mounted on the housing; the cover defines a receiving groove to receive the first sensing component; the receiving groove accommodates an end of the housing with the second vapor outlet.

3. The electronic atomizer capable of automatically generating vapor according to claim 2, wherein a mouthpiece is disposed on the housing, the second vapor outlet is defined at the mouthpiece, the mouthpiece is accommodated in the receiving groove.

4. The electronic atomizer capable of automatically generating vapor according to claim 1, further comprising a main board disposed within the housing, the main board being electrically connected to the atomization device, the blowing device, and the second sensing component.

5. The electronic atomizer capable of automatically generating vapor according to claim 1, further comprising:

a button, disposed on the housing and electrically connected to the main board; and a microphone, disposed within the housing and located on an airway between the first vapor outlet and the second first air inlet, the microphone electrically connected to the main board.

6. The electronic atomizer capable of automatically generating vapor according to claim 5, wherein a third vapor outlet is defined on the cover, the third vapor outlet is communicated with the second vapor outlet.

7. The electronic atomizer capable of automatically generating vapor according to claim 6, wherein the housing comprises an outer casing and a base; the second vapor outlet is defined at one end of the outer casing; the atomization device is detachably connected to the base; when the base is connected to the outer casing, the atomization device is received within the outer casing.

8. The electronic atomizer capable of automatically generating vapor according to claim 7, wherein the cover and the second sensing component are respectively disposed on the outer casing, and the main board is disposed within the base; the second sensing component is electrically connected to the main board through contact pins and contact points; the electronic atomizer further comprises a power supply, disposed within the outer casing and electrically connected to the main board through contact pins and contact points.

9. The electronic atomizer capable of automatically generating vapor according to claim 7, further comprising a mounting seat, and an electrode, the mounting seat and the electrode being electrically connected to the main board to form a positive pole and a negative pole; the mounting seat being disposed on the base and defining a first through hole, the electrode being disposed within the first through hole, and an insulating member being located between the electrode and the mounting seat; the electrode defining a second through hole; the atomization device being connected to the mounting seat and simultaneously coming into contact with the electrode, the second air inlet being communicated with the second through hole; the blowing device being disposed on one side of the second through hole away from the atomization device.

10. The electronic atomizer capable of automatically generating vapor according to claim 9, further comprising a ventilation component, the ventilation component having a first air outlet and a second air outlet that are communicated with each other;

the first air outlet being coupled to one end of the electrode away from the atomization device, enabling communication between the first air outlet and the second through hole; the blowing device being connected to the second air outlet, allowing the blowing device blows air towards the second air outlet.

* * * * *